United States Patent [19]

Adachi et al.

[11] Patent Number: 4,569,604

[45] Date of Patent: Feb. 11, 1986

[54] PRINTING HEAD APPARATUS AND MANUFACTURING METHOD

[75] Inventors: Yukio Adachi; Hiroshi Honma; Satoshi Ohkouchi, all of Tokyo, Japan

[73] Assignee: Tokyo Shibaura Denki Kabushiki Kaisha, Kawasaki, Japan

[21] Appl. No.: 563,989

[22] Filed: Dec. 21, 1983

[30] Foreign Application Priority Data

Dec. 25, 1982 [JP] Japan ..... 57-232804

[51] Int. Cl.[4] ..... B41J 3/02; B41J 3/10

[52] U.S. Cl. ..... 400/124; 101/93.05; 228/126; 219/85 M

[58] Field of Search ..... 400/124; 101/93.05; 219/85 A, 85 R, 85 M, 118; 228/208, 209, 210, 126, 132, 176, 101

[56] References Cited

U.S. PATENT DOCUMENTS

| | | | |
|---|---|---|---|
| 2,685,125 | 8/1954 | Hansen et al. | 228/208 X |
| 3,269,693 | 1/1967 | Carter | 228/209 X |
| 3,905,828 | 9/1975 | Barber | 228/126 X |
| 4,000,801 | 4/1977 | Baumeister et al. . | |
| 4,011,981 | 3/1977 | Danna et al. | 228/208 |
| 4,176,975 | 4/1979 | DeBoskey et al. . | |
| 4,259,653 | 3/1981 | McGonigal | 400/124 X |
| 4,304,495 | 12/1981 | Wada et al. | 400/124 |
| 4,307,966 | 12/1981 | Spencer et al. | 400/124 |
| 4,317,635 | 3/1982 | Englund et al. | 400/124 |
| 4,420,266 | 12/1983 | Kolm et al. | 400/124 |
| 4,428,691 | 1/1984 | Suzuki et al. | 400/124 |
| 4,444,519 | 4/1984 | Howell et al. | 400/124 X |
| 4,457,635 | 7/1984 | Takezawa et al. | 400/124 |

FOREIGN PATENT DOCUMENTS

| | | |
|---|---|---|
| 2947398 | 5/1981 | Fed. Rep. of Germany . |

*Primary Examiner*—Edgar S. Burr
*Assistant Examiner*—James R. McDaniel
*Attorney, Agent, or Firm*—Cushman, Darby & Cushman

[57] ABSTRACT

A printing head apparatus for impact dot printing and a method for manufacturing the apparatus, wherein those portions of the armature, printing wire and collar which are to be held in contact with each other and those other portions thereof which are to be set adjacent to each other are all bonded together by a brazing material in such a manner that one end of the printing wire is fitted to one end of the armature, and the collar penetrated by the printing wire is held in contact with said one end of the armature.

3 Claims, 8 Drawing Figures

PRINTING HEAD APPARATUS AND MANUFACTURING METHOD

BACKGROUND OF THE INVENTION

This invention relates to a printing head apparatus for use with an impact dot printer and a manufacturing method of such an apparatus.

A printing head apparatus used with an impact dot printer is generally constructed as shown in FIG. 1. When a solenoid is excited, an armature 3 swings toward a core 1 by magnetic attraction with one end of said armature 3 used as a fulcrum. One end of a printing wire 4 is fitted to the other end of the armature 3. Dot printing is carried out when the printing wire 4 is moved by the actuation of the armature 3, and the other end of said printing wire 4 pushes an ink ribbon onto a sheet of paper (not shown). When the exciting force of the solenoid 2 is released, the armature 3 returns to its original position by the repulsive force of a return plate spring 5. This return plate spring 5 is fixed at one end, and imparts a returning force to the armature 3 by means of a collar 6 acting as a spacer for the armature 3. The collar 6 is generally made of a metal, for example, stainless steel, in the form of a cylinder, and interposed between the armature 3 and return plate spring 5 with the collar 6 being penetrated by the printing wire 4.

An exemplary arrangement of the printing head apparatus of FIG. 1 is shown in FIG. 2. A plurality of printing wires corresponding to the number of printing dots to be impressed on a sheet of paper are arranged in a circular form. The plural printing wires 4 are guided at their other end toward a sheet of paper (not shown) by a plurality of guides 10. The plural guides 10 are held in a prescribed housing 11. The printing wires 4 pass through holes 12 of corresponding return plate springs 5. The return plate springs 5 correspond in number to that of the printing wires 4 and are fixed to a plate spring holder 13 in a circular form. The armature 3 fitted to the printing wire 4 is magnetically attracted toward the core 1 by exciting the solenoid 2 which is set between the core 1 and plate spring holder 13. The solenoid 2 is constructed by winding a coil 15 around an iron core 14. When the excitation of the solenoid 2 is released, the armature is returned to its original non-printing position by the repulsive force of the return plate spring 5, as previously described. The returned armature 3 is retained at a prescribed position by a stopper 16 made from, for example, synthetic resin or rubber. The stopper 16 is mounted on the inner wall of a rear case 17, which forms a housing of the printing head apparatus.

The structural section (a dotted circle 7 of FIG. 1) of the aforementioned printing head apparatus, which includes armature 3, printing wire 4 and collar 6 assembly, is particularly important to the operation of the printing head apparatus. As seen from FIG. 3 (which is a partial, enlarged view of FIG. 1 omitting plate spring 5), the structural section 7 is constructed by joining one end of the printing wire 4 to one end of the armature 3 with brazing material 10 such as silver or copper. The collar 6 penetrated by the printing wire 4 is welded at one end to the armature 3 by means of adhesive (i.e., not brazing materials). However, the conventional printing head apparatus constructed as described above has the drawbacks that the components of the apparatus are assembled by materials of different qualities such as the brazing material 10 and the adhesive agent. As seen from FIG. 4 (an enlarged cross sectional view of FIG. 3), the armature 3 and printing wire 4 are held together by an extremely small portion of the brazing material 10, thereby resulting in a decline in the mechanical strength of the abovementioned structural section 7. Further, said structural section 7 is manufactured by a plurality of steps, that is, the brazing of the components and their joining by adhesive, leading to an increase in the number of steps of manufacturing the printing head apparatus, and consequently in the cost thereof.

SUMMARY OF THE INVENTION

It is accordingly an object of this invention to provide a printing head apparatus and construction method for an impact dot printer, characterized in that a structural section includes an assembly of an armature, printing wires and collar, increased in mechanical strength, and manufactured by fewer steps than required in the past, thereby assuring the mechanical stability of said structural section and providing reliable dot printing, while reducing the cost of manufacturing the printing head apparatus.

A printing head apparatus embodying this invention comprises an armature, printing wire collar and solenoid for driving the armature and those portions of said armature, printing wire and collar which are to be connected together or set adjacent to each other are integrally assembled by brazing. When, therefore, dot printing is carried out by exciting the solenoid, the structural section comprising the assembly of the most important components using this invention, namely, the armature, printing wire and collar, has its mechanical strength increased. Moreover, the aforesaid structural section can be simply fabricated by brazing, thereby reducing the steps required to manufacture the printing head apparatus.

DETAILED DESCRIPTION OF THE PREFERRED EMBODIMENT

Figure 1:
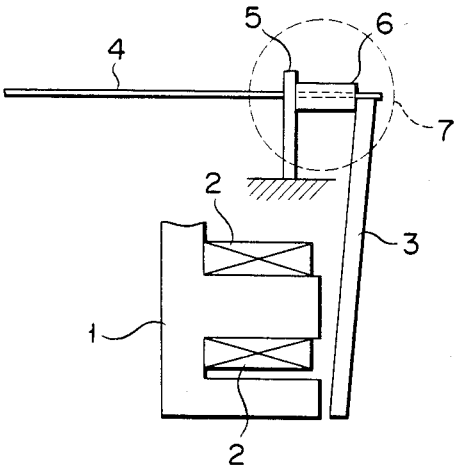
FIG. 1 (PRIOR ART)
FIG. 1 is a partial arrangement of the conventional printing head apparatus.
Figure 2:
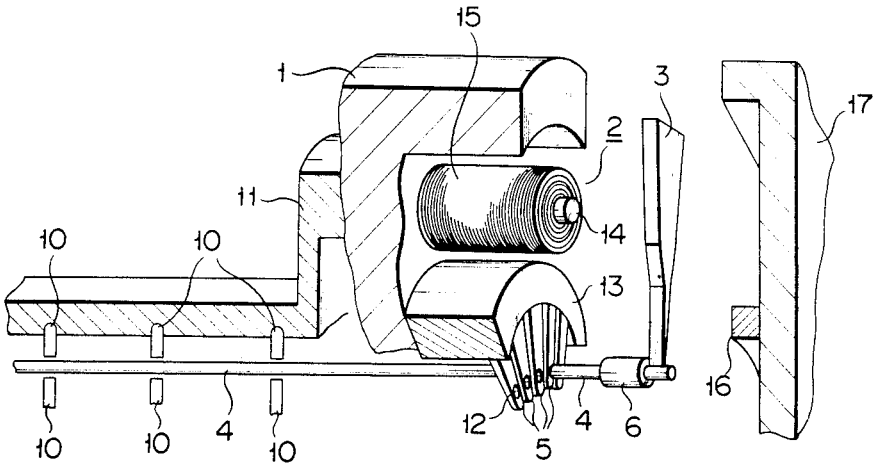
FIG. 2 (PRIOR ART)
FIG. 2 is an oblique sectional view of the printing head apparatus of FIG. 1, showing some of the dismembered parts.
Figure 3:
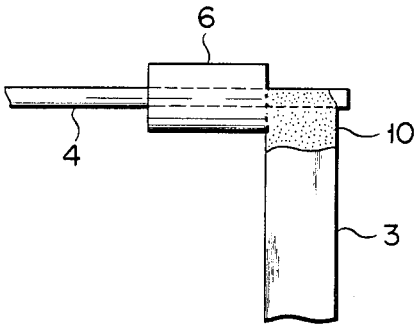
FIG. 3 (PRIOR ART)
FIG. 3 is a partial enlarged view of FIG. 1.
Figure 4:
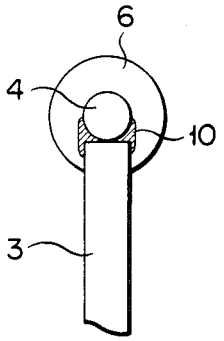
FIG. 4 (PRIOR ART)
FIG. 4 is an enlarged cross sectional view of FIG. 3.
Figure 5:
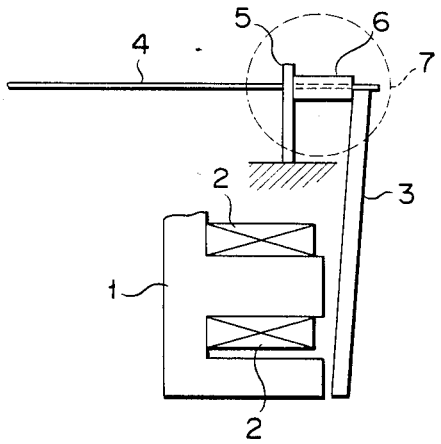
FIG. 5 is a partial structure of a printing head apparatus embodying this invention.

FIG. 5 shows a portion of the structure of a printing head apparatus embodying this invention. When the solenoid 2 is excited, the armature 3 swings toward a core 1 by magnetic attraction with one end of said armature 3 used as a fulcrum. One end of a printing wire 4 is connected to the other end of the armature 3. The printing wire 4 penetrates a cylindrical collar 6 and is fitted to the other end of the armature 3. The collar 6 is connected to the armature 3 at one end and to a return plate spring 5 at the other end.

Figure 6:
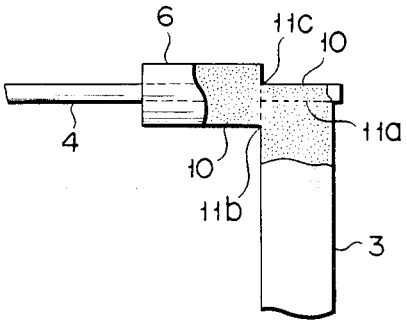
FIG. 6 is a partial enlarged view of FIG. 5.

FIG. 6 is a partial enlarged view of the structural section of FIG. 5 (dotted circle 7). Those portions 11*a*, 11*b*, 11*c* of the structural section 7 comprising an assembly of the armature 3, printing wire 4 and collar 6 which are to be connected are brazed together with brazing material 10. As can be seen in FIG. 6, the brazing material is caused to flow about the armature 3, a portion of the printing wire 4 (which extends beyond the collar 6 and contacts armature 3) and collar 6. In this cae, the armature 3 is generally made of silicon steel (composed of 99% iron and 1% silicon). The printing wire 4 is formed of an alloy of tungsten carbon and cobalt (composed of 84–86% tungsten carbon and 14 to 16% cobalt). The collar 6 is made stainless steel (composed of 74% iron, 8% nickel and 18% chromium).

Figure 7:
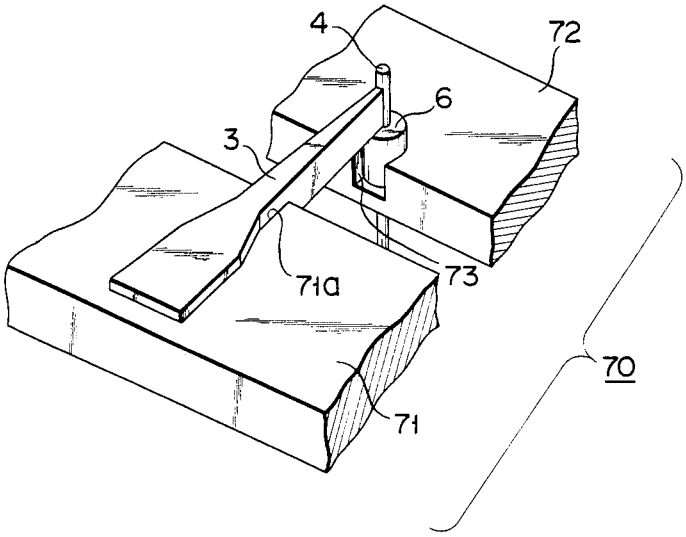
FIG. 7 is a partial oblique view of a jig applied in the manufactured of the printing head apparatus of the invention.
Figure 8:
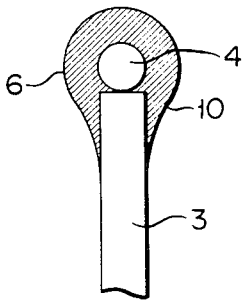
FIG. 8 is an enlarged cross sectional view of FIG. 6.

The structural section of FIG. 6 is manufactured by applying a jig indicated in FIG. 7. The jig 70 is formed of a first component 71 and second component 72. The components 71, 72 are spatially set on the same plane. The first component 71 is provided with a notched portion 71*a* conformable to the outline of one end portion of the armature 3 to hold said end portion. The second component 72 is provided with a notched portion 73 to hold the collar 6 as shown in FIG. 7. The second component 72 of the jig 70 holds the collar 6 in contact with the other end of the armature 3 and the end of the printing wire 4. The collar 6 is held in the notched portion 73. The printing wire 4 is allowed to pass through the collar 6. At this time, the printing wire 4 is supported by a hole formed in the notched portion 73 (underneath collar 6 in FIG. 7). The armature 3 is set in position with component 71 and held in contact with one end of the printing wire 4 and part of one end of the collar 6 by component 72. Molten brazing material is supplied to those portions of the armature 3, printing wire 4 and collar 6 which are held in the second component 72 of the jig 70 to be brought into contact with each other. Thus, the other end of the armature 3 and one end of the printing wire 4 are connected together. One particular section of the other end of the armature 3 (that section thereof which extends at right angles to that section of said armature 3 which is held in contact with the printing wire 4) is connected to part of one end of the collar 6. The inner diameter of the collar 6 is generally chosen to be slightly larger than the diameter of the printing wire 4. Therefore, the molten brazing material also flows into the cavity of the collar 6 penetrated by the printing wire 4, causing the printing wire 4 to be held in contact with the inner wall of the collar cavity. The brazing operation provides the important structural section 7 (FIG. 5) constituted by the collar 6, printing wire 4 and armature 3 all held together by the brazing material 10. A sufficient amount of the brazing material 10 prepared from, for example, silver brazing material (composed of 56% silver, 22% copper, 17% zinc and 5% tin) assures the mutual bonding of the armature 3, printing wire 4 and collar 6, as seen from FIG. 8. As previously mentioned, the brazing material 10 flows into a space defined between the inner wall of the collar 6 and the outer peripheral wall of the printing wire 4, thereby increasing the mechanical strength of the structural section 7 (FIG. 5), for example, to better withstand the vibrations and shearing stresses caused by the dot-printing operation of the wire 4. The printing head apparatus-manufacturing method of this invention provides the structural section 7 (FIG. 5) by the brazing step alone, thereby better facilitating the manufacture of the printing head apparatus at a lower cost than the conventional method.

What is claimed is:

1. A printing head apparatus comprising:

a printing wire for performing dot printing by the impingement of one end thereof on a sheet of paper;

an armature, having one end connected to the other end of said printing wire;

solenoid means for attracting, when excited, said armature so as to cause said armature to pivot about the other end of said armature, causing said printing wire to move from a nonprinting position to a printing position;

a return plate spring for causing said armature to return said printing wire to said nonprinting position when said solenoid means is not being excited; and cylindrical collar means having a hole along its cylindrical axis, said printing wire penetrating completely through said hole and extending beyond said hole, said collar means being interposed between said return plate spring and said one end of said armature, for transmitting a returning force of said return plate spring to said armature, said collar means being connected to said one end of said armature and said printing wire; and a single unitary mass of brazing material disposed in said hole between said printing wire and the surface of said hole and about said collar means, about said armature and about a portion of said printing wire extending beyond said collar means, said brazing material connecting said armature, printing wire and collar in an integral assembly.

2. The printing head apparatus according to claim 1, wherein said collar means defines a cavity having an inside diameter larger than the diameter of said printing wire to allow said brazing material to be disposed between said inside diameter of said collar means and said wire.

3. The printing head apparatus according to claim 1, wherein said brazing material comprises at least one of silver, copper, tin and zinc.

* * * * *